US008443616B2

(12) United States Patent
Cullen

(10) Patent No.: US 8,443,616 B2
(45) Date of Patent: May 21, 2013

(54) REPLACEMENT BASIN FOR REFRIGERATED COUNTER

(76) Inventor: Thomas P. Cullen, Clinton Township, MI (US)

( * ) Notice: Subject to any disclaimer, the term of this patent is extended or adjusted under 35 U.S.C. 154(b) by 406 days.

(21) Appl. No.: 12/828,578

(22) Filed: Jul. 1, 2010

(65) Prior Publication Data

US 2011/0061417 A1 Mar. 17, 2011

Related U.S. Application Data

(60) Provisional application No. 61/242,607, filed on Sep. 15, 2009.

(51) Int. Cl.
*F25D 23/12* (2006.01)

(52) U.S. Cl.
USPC ..... 62/258; 62/298

(58) Field of Classification Search ..... 62/115, 62/258, 298, 259.1
See application file for complete search history.

(56) References Cited

U.S. PATENT DOCUMENTS

| | | | | |
|---|---|---|---|---|
| 4,284,880 | A * | 8/1981 | Keiser | 219/415 |
| 4,802,340 | A | 2/1989 | Johnson | |
| 5,247,807 | A | 9/1993 | Jarman et al. | |
| 5,363,672 | A * | 11/1994 | Moore et al. | 62/258 |
| 6,202,432 | B1 * | 3/2001 | Haasis | 62/258 |
| 6,400,616 | B1 * | 6/2002 | Tamura et al. | 365/198 |
| 6,434,961 | B2 * | 8/2002 | Richmond et al. | 62/258 |
| 6,564,570 | B2 * | 5/2003 | Koike et al. | 62/258 |
| 2003/0121149 | A1 | 7/2003 | Lauer et al. | |

* cited by examiner

*Primary Examiner* — Mohammad Ali
(74) *Attorney, Agent, or Firm* — Gifford, Krass, Sprinkle, Anderson & Citkowski, P.C.; Mark D. Schneider

(57) ABSTRACT

A replacement basin for a refrigerated counter having an integral basin and a method of installing that replacement basin is disclosed. Upon removing of the existing integral basin, the replacement basin may be mounted to the refrigerated counter, connected to the counter's existing refrigeration system, and then used to support one or more removable product filled bins or containers.

9 Claims, 5 Drawing Sheets

REPLACEMENT BASIN FOR REFRIGERATED COUNTER

CROSS-REFERENCE TO RELATED APPLICATIONS

This Application claims the benefit of U.S. Provisional Application 61/242,607, filed Sep. 15, 2009, the disclosure of which is incorporated by reference herein in its entirety.

FIELD OF THE INVENTION

A basin or vessel is disclosed as a replacement for the integrated basin portion of a refrigerated counter. The replacement basin may be mounted to the refrigerated counter, connected to the counter's existing refrigeration system, and then used to support one or more removable product filled bins or containers.

BACKGROUND OF THE INVENTION

Refrigerated counters (including tables) have a variety of uses, but they are often used to store and display consumables at a predetermined minimum temperature. The counters, for example, are particularly popular in the fast-food industry where they are used to store and display consumables (e.g., lettuce, cheese, etc.) in open top, removable bins that are recessed within a basin(s) integrated into each counter.

Refrigerated counters may cost in excess of $50,000 each. These counters typically include at least an onboard refrigeration unit positioned under the countertop and an integrally formed or constructed countertop basin. A counter, as mentioned above, may also be outfitted with one or more open top, removable bins. The bins are designed to be recessed within the basin and may used to store and display the consumables. Counters may also be constructed to perform according to current health and safety requirements established by government and/or industry. These requirements may mandate, for example, that the open top bins positioned in the basin be maintained at a predetermined minimum temperature. NSF Standard 7, for example, established by SF International contains requirements for refrigerators and freezers used to store and/or display cold food.

The use of an integral basin in each counter allows for easy maintenance and cleaning of the basin and the counter. However, the integral construction also means that the basin cannot simply be removed from the counter. This can become particularly problematic to a user of the counter whenever changes are made to the government and/or industry health and safety requirements that the user's existing counter may not meet. The expense of purchasing a new counter, when combined with a need to comply with new requirements, means the user must choose between upgrading to a new counter or failing to comply with health and safety requirements. Either decision can translate into considerable expense, inconvenience, and possible downtime for business operations.

It would be advantageous to provide for a replacement unit for an integral basin of a refrigerated counter that would allow an otherwise functional counter (including its refrigeration system) to continue in service following a change in health and safety requirements and/or damage to the basin.

SUMMARY OF THE INVENTION

A basin or vessel is disclosed as a replacement for a basin integrally constructed into an existing refrigerated counter.

The replacement basin may include a first or exterior frame that may support one or more second or interior frames, a refrigeration conduit, and optionally, a plurality of removable bins. The basin and its components may be constructed of stainless steel with the conduit being formed from copper. Although, other materials known, used or adopted by the art may also be used in the construction of the basin or its components.

In operation, the replacement basin may be installed into a refrigerated table or counter by first powering down the integral refrigeration unit of the counter and recovering any coolant present in that unit. The existing integral basin may then be separated from the existing refrigeration unit by severing the coolant lines of the unit at a predetermined location. Thereafter, the integral basin may be excised from the counter by cutting the basin away substantially along its perimeter and then lifting the basin out of the counter. After removal of the integral basin, the replacement basin may be positioned in the cutout formed by the removal of the prior basin. The replacement basin may then be further secured to the counter by welding, commercial adhesives, fasteners, or the like. Finally, the conduit lines of the replacement basin may then be connected to the coolant lines of the integral refrigeration unit.

BRIEF DESCRIPTION OF THE DRAWINGS

Reference will now be had to the associated figures wherein like reference numerals refer to like parts throughout and wherein.

DETAILED DESCRIPTION OF THE PREFERRED EMBODIMENTS

Figure 1:
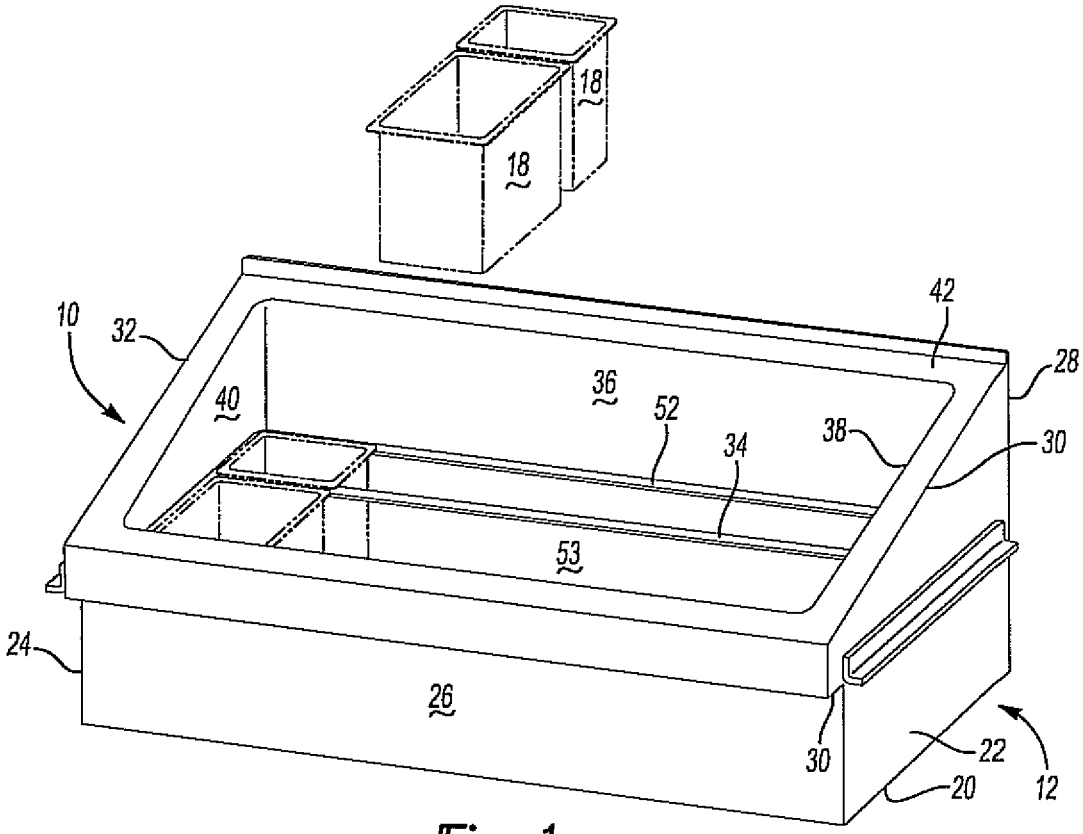
FIG. 1 is a perspective view of a replacement basin constructed in accordance with the present invention showing also the removable food bins.
Figure 2:
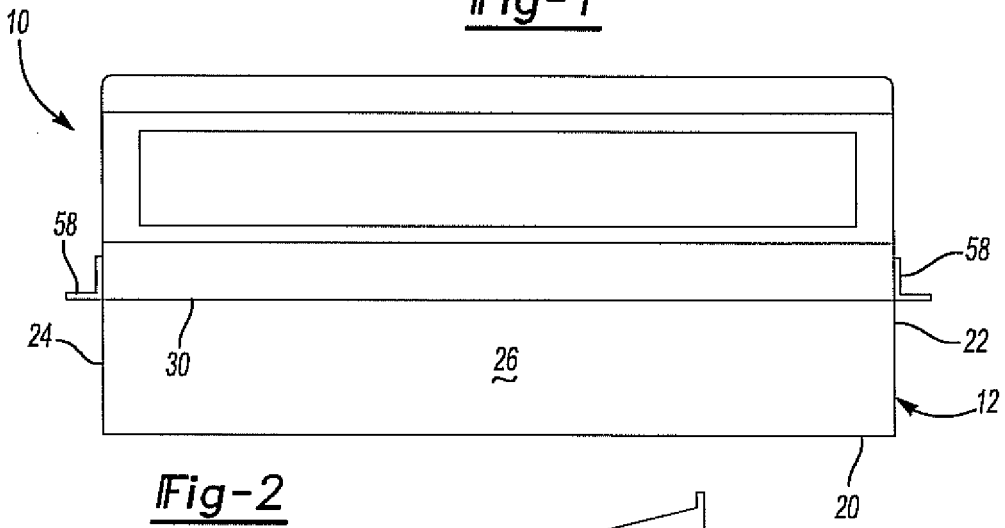
FIG. 2 is a planar front view of the basin shown in FIG. 1.
Figure 3:
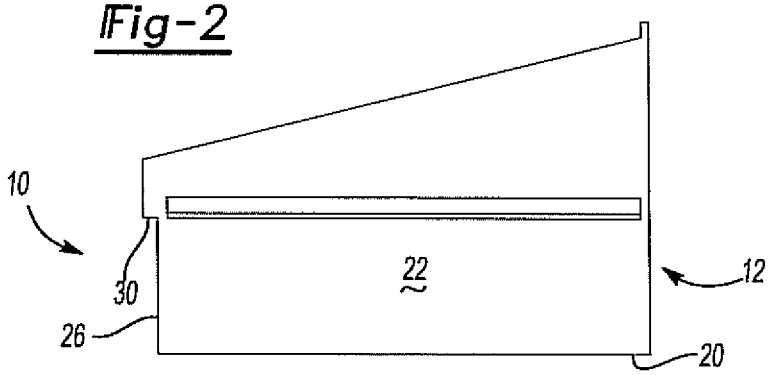
FIG. 3 is a planar side view of the basin of FIG. 1.

Referring now to FIGS. 1-10, a basin 10 or vessel is disclosed as a replacement for a basin (not shown) integrated into a refrigerated counter (not shown). The replacement basin 10 may include a first or exterior frame 12 that may support one or more second or interior frames 14, a refrigeration conduit 16, and optionally, a plurality of removable bins 18. The frames 12, 14 may be constructed of stainless steel with the conduit 16 being formed from copper. Although, other materials known, used or adopted by the art may also be used in the construction of the basin 10 or its components.

Figure 4:
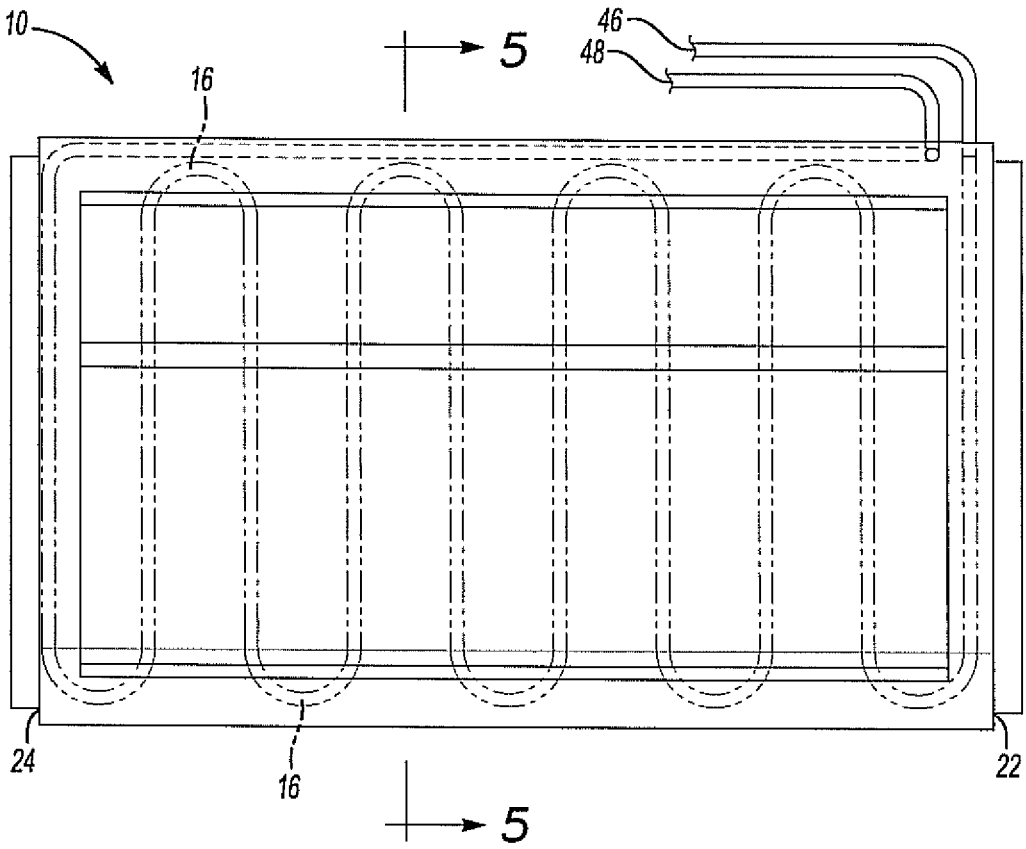
FIG. 4 is a planar rear view of the basin of FIG. 1 showing the refrigeration lines for the basin principally in phantom.
Figure 5:
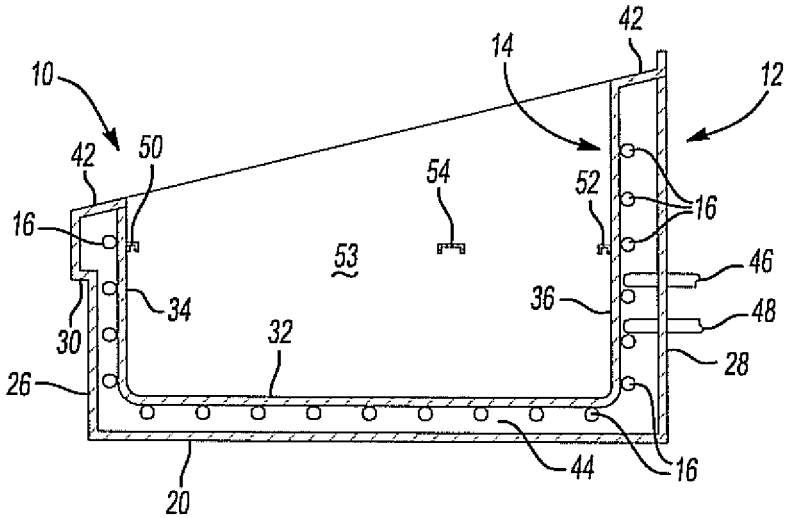
FIG. 5 is a planar side cutaway view of the basin of FIG. 1 taken along line 5-5 of FIG. 4.
Figure 6:
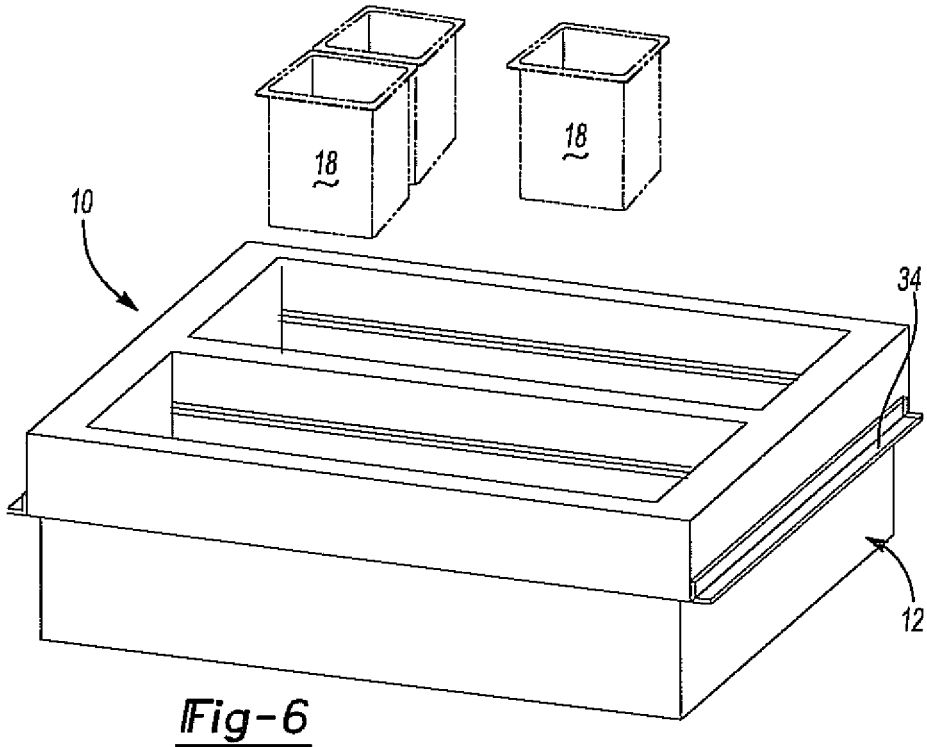
FIG. 6 is a perspective view of another embodiment of a replacement basin constructed in accordance with the present invention showing the removable bins in phantom.
Figure 7:
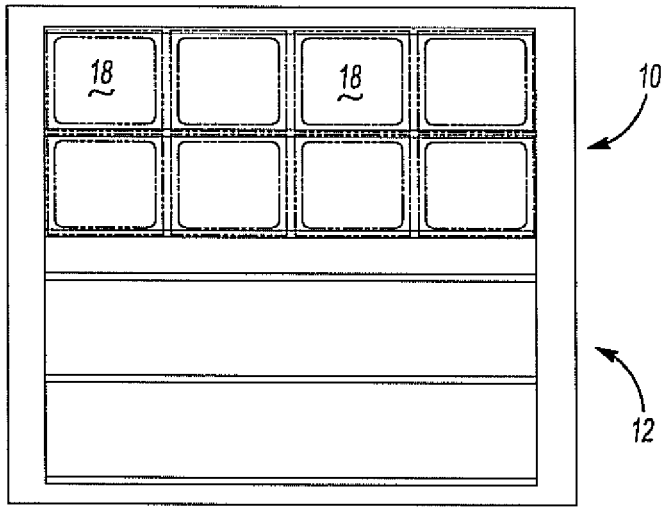
FIG. 7 is a top planar view of the replacement basin of FIG. 6.
Figure 8:
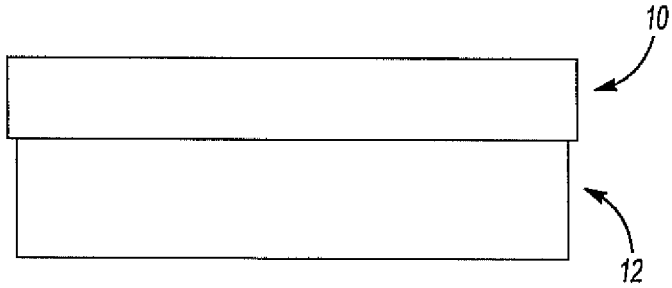
FIG. 8 is a side planar view of the replacement basin of FIG. 6.

Referring now to FIGS. 1-5, the first frame 12 may be formed as a receptacle or sink-like structure having a base or floor 20, a pair of spaced apart end walls 22, 24, a front wall 26, and a rear or back wall 28. As shown in FIG. 5, the rear wall 28 of the first frame 12 may be dimensioned longer and/or higher than the front wall 26 so that the upper edge 30, 32 of each end wall 22, 24 (see FIGS. 1 and 3) extends diagonally between the front 26 and rear 28 walls. The front wall 26 of the first frame 12 may also include a flange or lip 30 that may be used to support and/or position the basin 10 on the counter (not shown) as will be described further below.

Still referring to FIGS. 1-5, the second frame 14 may, similar to the first frame 12, be constructed to include a base or floor 32, a front wall 34, a rear wall 36, and a pair of opposed end walls 38, 40. However, as again shown in FIG. 5, the second frame 14 may be dimensioned smaller than the first 12 so that it may be recessed within the first frame 12 and have surfaces 32-40 that are spaced predetermined distances from the comparable surfaces 20-28 of the first frame 12. The second frame 14 may also be formed with (or secured to, see FIGS. 6-10 infra) a web or flange 42 that connects the frames 12, 14 along the upper edge or perimeter of the walls of the frames 12, 14.

Referring now to FIGS. 4 and 5, the refrigeration conduit 16 may be positioned in the basin 10 in the space 44 defined between the first and second frames 12, 14. The conduit 16 may engage or be positioned proximate to the surfaces 32-40 of the second frame 12 to aid in cooling those surfaces (which as will be described infra, aids in the cooling of consumables or removable bins 18 positioned in the second frame 14). Additionally, or alternatively, the conduit 16 may be positioned so that at least a portion is located above (or in a higher plain relative to the top of) the bins 18. Positioning the conduit 16 so that the conduit 16 may be above (or higher) than the tops of the bins 18 chills the air above those bins 18 and allows the temperature above and along the entire length of each bin 18 to be maintained at or below a predetermined minimum temperature. An inlet 46 and outlet 48 for the refrigeration conduit 16 may extend from the rear wall 28 of the first frame 12. However, it will be appreciated that the position of the inlet 46 and outlet 48 for the conduit 16 may be modified according to the needs of the user.

Referring now to FIG. 1, support flanges 50, 52 may be positioned along second frame. For example, as shown support flanges 50, 52 may be positioned along the front 34 and rear 36 wall of the second frame 14 and configured so that they may extend into the open receptacle or sink 53 defined by the frame 14. An intermediate support rod 54 may also be provided that extends between the end walls 38, 40 of the second frame 12. The bins 18 may then be removably positioned in the receptacle or sink 52 defined by the second frame 14, and supported by the flanges 50, 52 and rod 54. As such, it will be appreciated that consumables in the bins 18 may be refrigerated down to a predetermined temperature by operation of the conduit 16 cooling the surfaces 32-40 of the second frame 14. A predetermined amount of water (not shown) or fluid may also be provided into the receptacle or sink 52 of the second frame 14 so that the temperature is evenly distributed around several bins 18. Where a fluid is used (or intended to be used), the basin 10 may also be provided with one or more drains (not shown).

Referring now to FIGS. 1-4, a basin support flange 58 may be provided along each end wall 20, 22 of the first frame 12 of the basin 10 and used for mounting the replacement basin 10 unit to a refrigerated counter.

Figure 9:
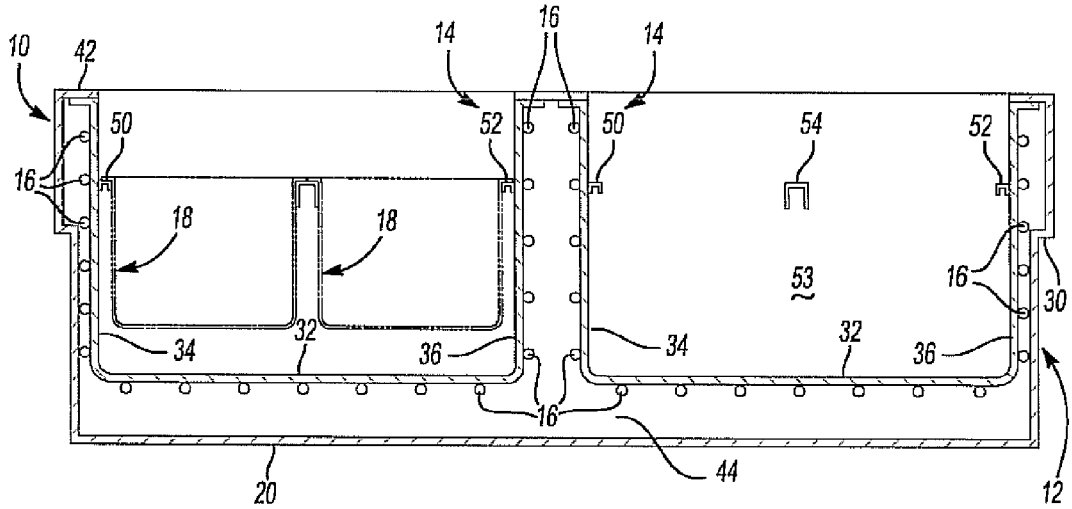
FIG. 9 is a planar side cutaway view of the replacement basin shown in FIG. 6.
Figure 10:
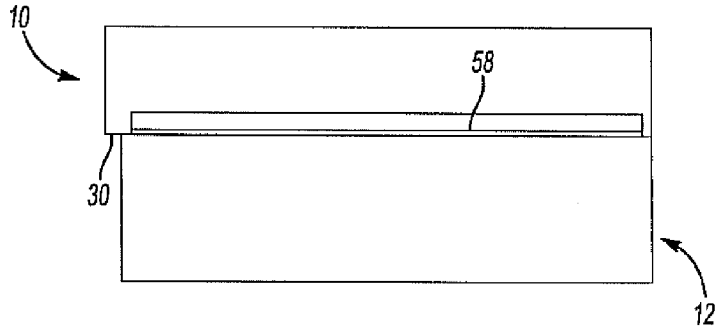
FIG. 10 is a planar side view of the replacement basin shown in FIG. 6.
Figure 11:
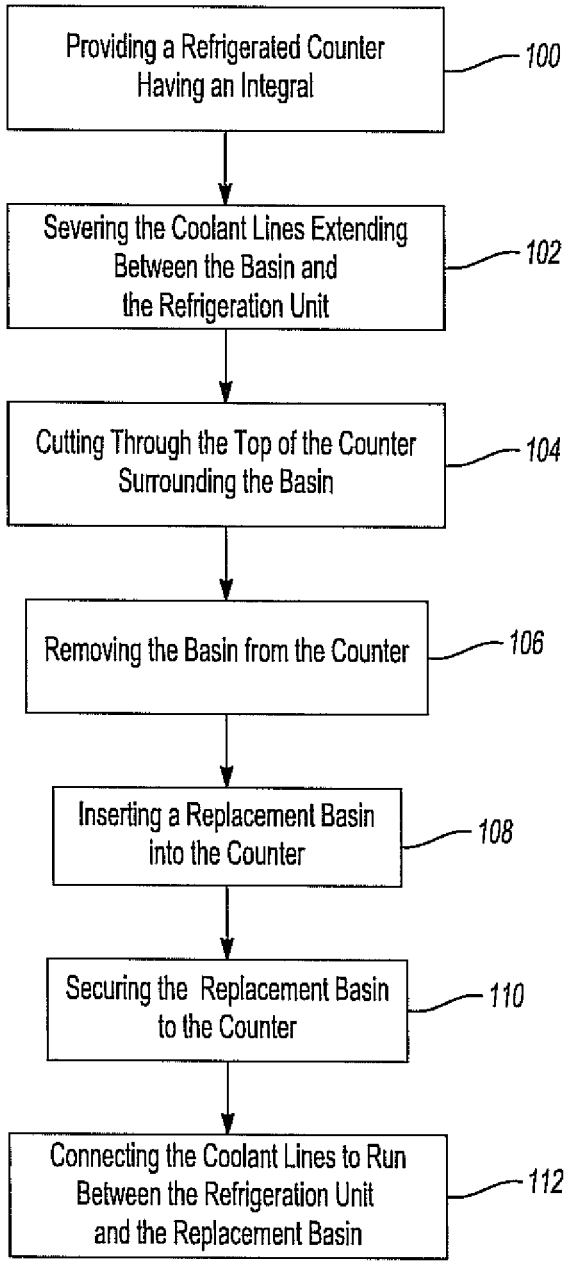
FIG. 11 is a flow-chart describing one embodiment of the disclosed method.

Referring now to FIGS. 6-10, and as best shown in FIG. 9, another embodiment of the replacement basin 10 may be constructed in which the front 26 and rear 28 walls of the first frame 12 have substantially the same dimensions. The basin 10 of this other embodiment may also include two or more inner or second frames 14, with each of these inner or second frames 14 including one or more removable bins 18. The end walls of the first frame 12 may also be configured so that the lip 30 extends around the ends of the basin 10.

Referring now to FIGS. 1-11, in operation, a replacement basin 10 may be installed into a refrigerated table (not shown) by first 100 powering down the integral refrigeration unit (not shown) of the counter and recovering any coolant present in that unit. The existing integral basin (not shown) may then be separated from the existing refrigeration unit by severing 102 the coolant lines (not shown) of the unit at a predetermined location. Thereafter, the integral basin may be excised from the counter by cutting 104 the basin away substantially along its perimeter and then lifting 106 the basin out of the counter. After removal of the integral basin, the replacement basin 10 may be positioned 108 in the cutout formed by the removal of the prior basin such that the basin support flanges 58 of the end walls and the lip 30 of the front wall 26 of the first frame 12 engage the countertop. The replacement basin 10 may then be further secured 110 to the counter by welding, commercial adhesives, fasteners, or the like. Finally, the conduit lines 16 of the replacement basin 10 may then be connected 112 to the coolant lines of the integral refrigeration unit using welding, fasteners (e.g., quick connect fasteners positioned on the ends of the conduit lines 16 of the basin 10), or similar connection means known in the art. It will also be appreciated that a similar procedure may be use to add one or more additional basins 10 to an existing counter that may or may not have a basin 10. However, in such instances, it may also be necessary to add one or more refrigeration units.

Having thus described my invention, various other embodiments will become known or apparent to those of skill in the art that do not depart from the scope of the invention as disclosed.

I claim:

1. A basin consisting of:

an exterior frame having a base, a pair of spaced apart end walls, and a front wall and a rear wall that connect the end walls, each wall extending from and being substantially perpendicular to the base, and each end wall having an outwardly extending basin support flange;

an interior frame positioned between and spaced apart from the walls of the exterior frame and being mounted to at least one of the exterior frame walls, the interior frame having a base, a pair of spaced apart end walls, and a front wall and a rear wall that connect the end walls, each wall of the interior frame extending from and being substantially perpendicular to the base of the interior frame, and being substantially parallel to the respective opposing wall of the exterior frame;

a refrigeration conduit positioned in the space defined between the interior frame and the exterior frame; and a plurality of bins, each bin having an open end, and the bins being removably positioned in and supported by the interior frame in a substantially side-by-side configuration so that the open ends of the bins are positioned in substantially the same horizontal plane and lay below an upper edge of the front wall of the exterior frame.

2. The basin of claim 1, wherein the rear walls of the frames are dimensioned longer than the front walls of the frames so that upper edges of the end walls of the frames extend diagonally between their respective front and rear walls.

3. The basin of claim 1, wherein the front wall of the exterior frame includes a lip.

4. A basin consisting of:

an exterior frame having a base, a pair of spaced apart end walls, and a front wall and a rear wall that connect the end walls, the front wall including a lip;

an interior frame positioned between and spaced apart from the walls of the exterior frame and being mounted to at least one of the exterior frame walls, the interior frame having a base, a pair of spaced apart end walls, and a front wall and a rear wall that connect the end walls, each wall of the interior frame extending from and being substantially perpendicular to the base of the interior frame, and being substantially parallel to the respective opposing wall of the exterior frame;

a refrigeration conduit positioned in the space defined between the interior frame and the exterior frame; and a plurality of bins, each bin having an open end, and the bins being removably positioned in and supported by the interior frame in a substantially side-by-side configuration so that the open ends of the bins are positioned in substantially the same horizontal plane and lay below an upper edge of the front wall of the exterior frame.

5. The basin of claim 4, wherein each end wall of the exterior frame defines a lip that intersects with the lip of the front wall so that the lip surface extends across the front wall and around the ends of the exterior of the basin.

6. The basin of claim 4, wherein each end wall having a basin support flange.

7. The basin of claim 4, wherein the rear walls of the frames are dimensioned longer than the front walls so that upper edges of the end walls of the frames extend diagonally between their respective front and rear walls.

8. A basin consisting of:

an exterior frame having a base, a pair of spaced apart end walls, and a front wall and a rear wall that connect the end walls, each wall extending from and being substantially perpendicular to the base, and each end wall having an outwardly extending basin support flange;

an first and a second interior frame, each interior frame being positioned between and spaced apart from the walls of the exterior frame and being mounted to at least one of the exterior frame walls, the interior frames each having a base, a pair of spaced apart end walls, and a front wall and a rear wall that connect the end walls, the walls of each interior frame extending from and being substantially perpendicular to the base of the interior frame;

a refrigeration conduit positioned in the space defined between the interior frames and the exterior frame; and a plurality of bins, each bin having an open end, and the bins being removably positioned in and supported by at least one of the interior frames in a substantially side-by-side configuration in the interior frame so that the open ends of the bins are positioned in the interior frame in substantially the same horizontal plane and lay below an upper edge of the front wall of the exterior frame.

9. The basin of claim 8, where the walls of each interior frame define an open end for the frame, with the open ends of the first and second interior frames being positioned in substantially the same horizontal plane.

* * * * *